US006913526B2

(12) United States Patent
Honda

(10) Patent No.: US 6,913,526 B2
(45) Date of Patent: Jul. 5, 2005

(54) POLISHING MACHINE FOR POLISHING PERIPHERY OF SHEET

(75) Inventor: Katsuo Honda, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 0 days.

(21) Appl. No.: 10/110,858

(22) PCT Filed: Aug. 17, 2001

(86) PCT No.: PCT/JP01/07100

§ 371 (c)(1),
(2), (4) Date: Apr. 17, 2002

(87) PCT Pub. No.: WO02/16076

PCT Pub. Date: Feb. 28, 2002

(65) Prior Publication Data

US 2002/0164934 A1 Nov. 7, 2002

(30) Foreign Application Priority Data

Aug. 18, 2000 (JP) ..... 2000-248818

(51) Int. Cl.[7] ..... B24B 7/00
(52) U.S. Cl. ..... 451/232; 451/44; 451/279
(58) Field of Search ..... 451/232, 279, 451/43, 44, 139, 174, 178, 236, 280, 310, 360

(56) References Cited

U.S. PATENT DOCUMENTS

| | | | | |
|---|---|---|---|---|
| 3,686,796 A | * | 8/1972 | Clark | 451/42 |
| 5,056,270 A | * | 10/1991 | Curcher | 451/43 |
| 5,295,331 A | | 3/1994 | Honda et al. | |
| 5,626,511 A | * | 5/1997 | Kennedy et al. | 451/461 |
| 6,220,938 B1 | * | 4/2001 | Stocker et al. | 451/49 |
| 6,306,016 B1 | * | 10/2001 | Steere et al. | 451/44 |

FOREIGN PATENT DOCUMENTS

| | | |
|---|---|---|
| EP | 0 958 889 A2 | 11/1999 |
| JP | 62-236666 | 10/1987 |
| JP | 2876572 | 6/1993 |
| JP | 5-152259 | 6/1993 |
| JP | 6-262505 | 9/1994 |
| JP | 9-174402 | 7/1997 |
| JP | 11-33888 | 2/1999 |

OTHER PUBLICATIONS

International Search Report of PCT/JP01/07100, dated Nov. 27, 2001.
Japan Office action dated Mar. 22, 2004 for corresponding Japanese patent application 2000–248818.
Patent Abstract of Japan Publication No. 05152259 A, Published on Jun. 18, 1993, in the name of Honda Katsuo, et al.
Patent Abstract of Japan Publication No. 62236666 A, Published on Oct. 16, 1987, in the name of Yamamoto Yutaka, et al.

* cited by examiner

*Primary Examiner*—Timothy V. Eley
(74) *Attorney, Agent, or Firm*—Christie, Parker & Hale, LLP

(57) ABSTRACT

A polishing machine for polishing a periphery of a sheet of the present invention comprises a grinding shaft tilting mechanism (1) capable of changing a tilting angle of a rotary shaft of a grinding stone (3) with respect to a rotary shaft of the sheet (2) and also capable of changing its tilting direction. Accordingly, in a recess portion or a protrusion portion in the periphery, when the tilting direction is changed while the tilting angle is being maintained, chamfering (polishing) can be executed with high accuracy in the same manner as that of the outer circumferential portion of the sheet.

6 Claims, 6 Drawing Sheets

POLISHING MACHINE FOR POLISHING PERIPHERY OF SHEET

CROSS REFERENCE TO RELATED APPLICATION

This application claims priority of International Patent Application No. PCT/JP01/07100, filed Aug. 17, 2001, which in turn claims priority of Japanese Patent Application No. 2000-248818, filed on Aug. 18, 2000.

BACKGROUND OF THE INVENTION

1. Technical Field of the Invention

The present invention relates to a polishing machine for polishing a periphery of a sheet when a rotating grinding stone is made to come into contact with a periphery of a rotating sheet. More particularly, the present invention relates to a polishing machine for polishing a periphery of a sheet suitably used for polishing a periphery of a sheet such as a semiconductor wafer, in the periphery of which a notch or orientation-flat marking is formed.

2. Background Art

A surface of a semiconductor wafer, which has been cut off by means of slicing, is polished, and a periphery of the semiconductor wafer is also polished in order to prevent the occurrence of cracks and the adhesion of dust. In this case, the periphery of the semiconductor wafer is polished in such a manner that an oblique face of a rotating grinding stone having grooves is pressed against the rotating semiconductor wafer so that a rotary shaft of the semiconductor wafer and that of the grinding stone can be parallel with each other.

However, in the above conventional method of polishing the periphery of the semiconductor wafer, as the abrasive grains move only in the circumferential direction of the semiconductor wafer, stripes are formed on the polished face in the periphery of the semiconductor wafer by partial blades of the grinding stone, that is, it is impossible to provide a polished face, the surface roughness accuracy of which is sufficiently high. When the surface roughness accuracy of the polished face of the periphery is insufficient as described above, the following problems may be encountered. A surface of the periphery is locally cracked and chips are generated from the cracks. Accordingly, dust adheres onto the surface of the periphery. Further, fine powder gets into the cracks, which could be a cause of generating dust. Furthermore, cleaning water staying in the cracks is vaporized in a later process, which has a bad effect on the after-process of manufacturing the wafer. In order to solve the above problems, the following countermeasures are taken. The grain size of the grinding stone is reduced to be more minute, the quantity of cutting is decreased, the number of times of dressing is increased, or the surface roughness accuracy of the polished face is enhanced by changing over several grinding stones (Two stages of grinding stones or three stages of grinding stones are used.). However, the effects provided by the above countermeasures are limited. Further, when the above countermeasures are adopted, the grinding efficiency is deteriorated.

Therefore, the present applicant has proposed the following technique which is disclosed in Japanese Examined Patent Publication No. 2876572. While a rotary shaft of a grinding stone is being tilted in the tangential direction of an outer circumference of a semiconductor wafer, a peripheral edge of the semiconductor wafer is polished. Due to the foregoing, a direction of the motion of abrasive grains of the grinding stone is tilted with respect to a polished face of the semiconductor wafer, and the occurrence of stripes on the polished face caused by partial blades of the grinding stone can be prevented. As a result, polishing can be executed with high accuracy.

However, the above polishing method is disadvantageous as follows. According to the above polishing method, the rotary shaft of the grinding stone can be tilted only in one direction. Therefore, when the semiconductor has a notch portion or orientation-flat marking portion, it is impossible to successfully polish the peripheral edge of the notch portion or orientation-flat marking portion.

SUMMARY OF THE INVENTION

In view of the above problems, it is an object of the present invention to provide a polishing machine for polishing a periphery of a sheet capable of accurately polishing the peripheral edge of the sheet including a recess portion and protrusion portion even when polishing is conducted on a sheet such as a semiconductor wafer, the peripheral edge of which has a recess portion or protrusion portion such as a notch portion or orientation-flat marking portion.

An embodiment of the polishing machine for polishing a periphery of a sheet of the present invention comprises a grinding stone shaft tilting mechanism, the tilting angle of the rotary shaft of the grinding stone of which can be changed in the tangential direction of the peripheral edge of the sheet, and the direction of tilting of which can be also changed. By the above grinding stone shaft tilting mechanism, the recess portion and the protrusion portion of the peripheral edge of the sheet can be polished with high accuracy.

According to another embodiment of the polishing machine for polishing a periphery of a sheet of the present invention, when the tilting angle of the grinding stone is adjusted according to a chamfering angle of the sheet, the peripheral edge of the sheet can be effectively and accurately polished.

According to still another embodiment of the polishing machine for polishing a periphery of a sheet of the present invention, when the recess portion or the protrusion portion of the peripheral edge of the sheet is polished, it is prescribed that a tilting direction of the rotary shaft of the grinding stone is adjusted according to the rotary angle of the sheet. Therefore, it is possible to polish the periphery in the recess portion and the protrusion portion with high accuracy.

According to still another embodiment of the polishing machine for polishing a periphery of a sheet of the present invention, it is prescribed that polishing is conducted at a bottom of the recess portion of the peripheral edge of the sheet while the tilting angle of the grinding stone is being kept at 0°.

According to still another embodiment of the polishing machine for polishing a periphery of a sheet of the present invention, it is prescribed that a polishing face of the grinding stone is formed into a face, the angle of which is the same as that of an oblique face angle of grinding stone grooves which are self-formed according to the tilting angle of the grinding stone having grooves. Since the face, the angle of which is the same as that of the oblique face of the grinding stone grooves is self-formed according to the tilting angle of the grinding stone, the number of the acting abrasive grains is increased, and the abrasive grains act uniformly. Therefore, the surface accuracy of the polished face can be enhanced.

According to still another embodiment of the polishing machine for polishing a periphery of a sheet of the present invention, a grinding stone, the degree of bonding of which is lower than that of the metal bond, is used. Therefore, the abrasive grains easily come off when an over-load is given to them, and the polished face can be prevented from being damaged.

According to still another embodiment of the polishing machine for polishing a periphery of a sheet of the present invention, it is restricted that the sheet is a semiconductor wafer and the recess portion is a notch portion or an orientation-flat portion.

The present invention will become more apparent from the following descriptions of the preferred embodiments with reference to the accompanying drawings.

BRIEF DESCRIPTION OF THE DRAWINGS

FIGS. 5A and 5B are views showing a spherical linear motor bearing which is another embodiment used for the grinding stone tilting mechanism, wherein FIG. 5A is a side view showing an outline of the spherical linear motor bearing, and FIG. 5B is a plan view showing an outline of the spherical linear motor bearing.

THE MOST PREFERRED EMBODIMENT

Figure 1:
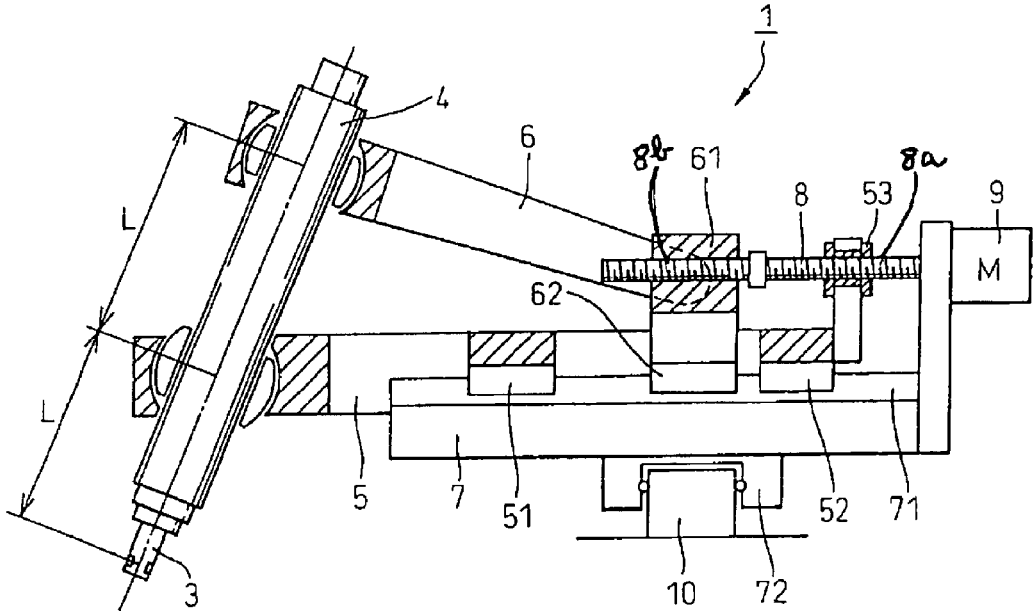
FIG. 1 is a side view showing an outline of a grinding stone tilting mechanism used for a polishing machine for polishing a periphery of a sheet according to an embodiment of the present invention.
Figure 2:
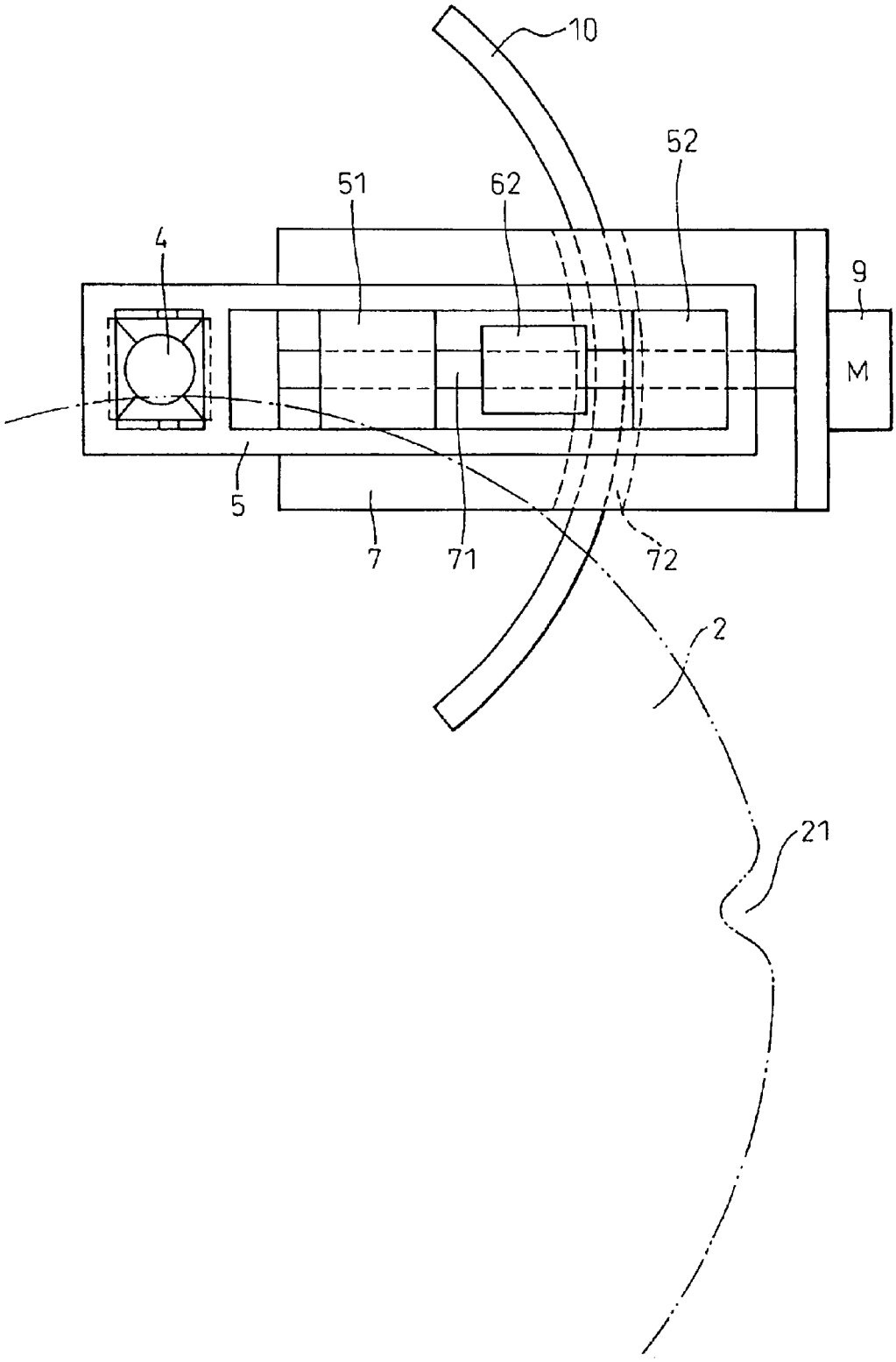
FIG. 2 is a plan view showing an outline of the grinding stone tilting mechanism shown in FIG. 1.

Referring to the accompanying drawings, an embodiment of the polishing machine for polishing a periphery of a sheet of the present invention will be explained as follows. FIG. 1 is a side view of the grinding stone tilting mechanism 1 of the polishing machine for polishing a periphery of a sheet of the present invention, and FIG. 2 is a plan view. The grinding section 3 for polishing the semiconductor wafer 2, which is a sheet, is fixed to the spindle 4 by a male screw portion provided on grinding section 3 which is screwed and fixed into a female screw portion provided on spindle 4. The spindle 4 is rotated by a rotation drive mechanism not shown. The spindle 4 is pivotally supported by the slider 5 at a position distant from the grinding section 3 by, for example, distance L. Further, the spindle 4 is pivotally supported by the arm 6 at a position distant from the grinding section 3 by, for example, distance 2L.

In the slider 5, the first linear bearings 51, 52, the number of which is two, are arranged at an interval in the linear direction. When these linear bearings are put on the guide rail 71 on the mount 7, the slider 5 can be linearly slid with respect to the mount 7. The motor 9 is arranged on the mount 7, and the slider 5 and the arm 6 are engaged with the screw member 8 which is driven by this motor 9. The screw member 8 is composed of a screw portion 8*a*, the pitch of which is 1.0, and a screw portion 8*b*, the pitch of which is 2.0. Screw portion 8*a* is meshed with the first nut member 53 which goes ahead and back when the screw member 8 is rotated. This nut member 53 is connected with the slider 5. The other screw portion 8*b* is meshed with the second nut member 61 which goes ahead and back when the screw member 8 is rotated. The arm 6 is pivotally connected with this second nut member 61. The second nut member 61 has the second linear bearing 62. Linear bearing 62 is put on the guide rail 71, which is arranged on the mount 7, so that the linear bearing 62 can be linearly slid. Accordingly, when the motor 9 is driven, the first linear bearings 51, 52 and the second linear bearing 62 linearly slide on the guide rail 71, so that the tilting angle of the spindle 4 in the axial direction can be changed.

A pitch ratio of the two screw portions 8*a* and 8*b* of the screw member 8 is set at 1:2. The reason is described as follows. A support point, at which the slider 5 supports the spindle 4, is distant from the grinding stone section 3 by distance L, and a support point, at which the arm 6 supports the spindle 4, is distant from the grinding stone section 3 by distance 2L, that is, the ratio is 1:2. Therefore, it is necessary for the pitch ratio of the two screw portions 8*a* and 8*b* of the screw member 8 to agree with this ratio. This pitch ratio must be changed according to the ratio of the distances of these support points. In the above embodiment, the slider 5 and arm 6 are moved by one motor, however, independent screw members, the pitches of which are different from each other, may be respectively driven by different motors.

According to the grinding stone tilting mechanism of the present invention, it is possible to change a tilting direction of the grinding shaft. At a lower portion of the mount 7, there is provided an arcuate curvature type bearing 72. When this arcuate curvature type bearing 72 is put on an arcuate guide rail 10, it is possible for the mount 7 to be moved in an arc. When this mount 7 is moved in an arc, an appropriate link mechanism or screw mechanism not shown is used. As described above, according to the grinding stone tilting mechanism of the present invention, both the tilting angle and the tilting direction can be changed.

Figure 3:
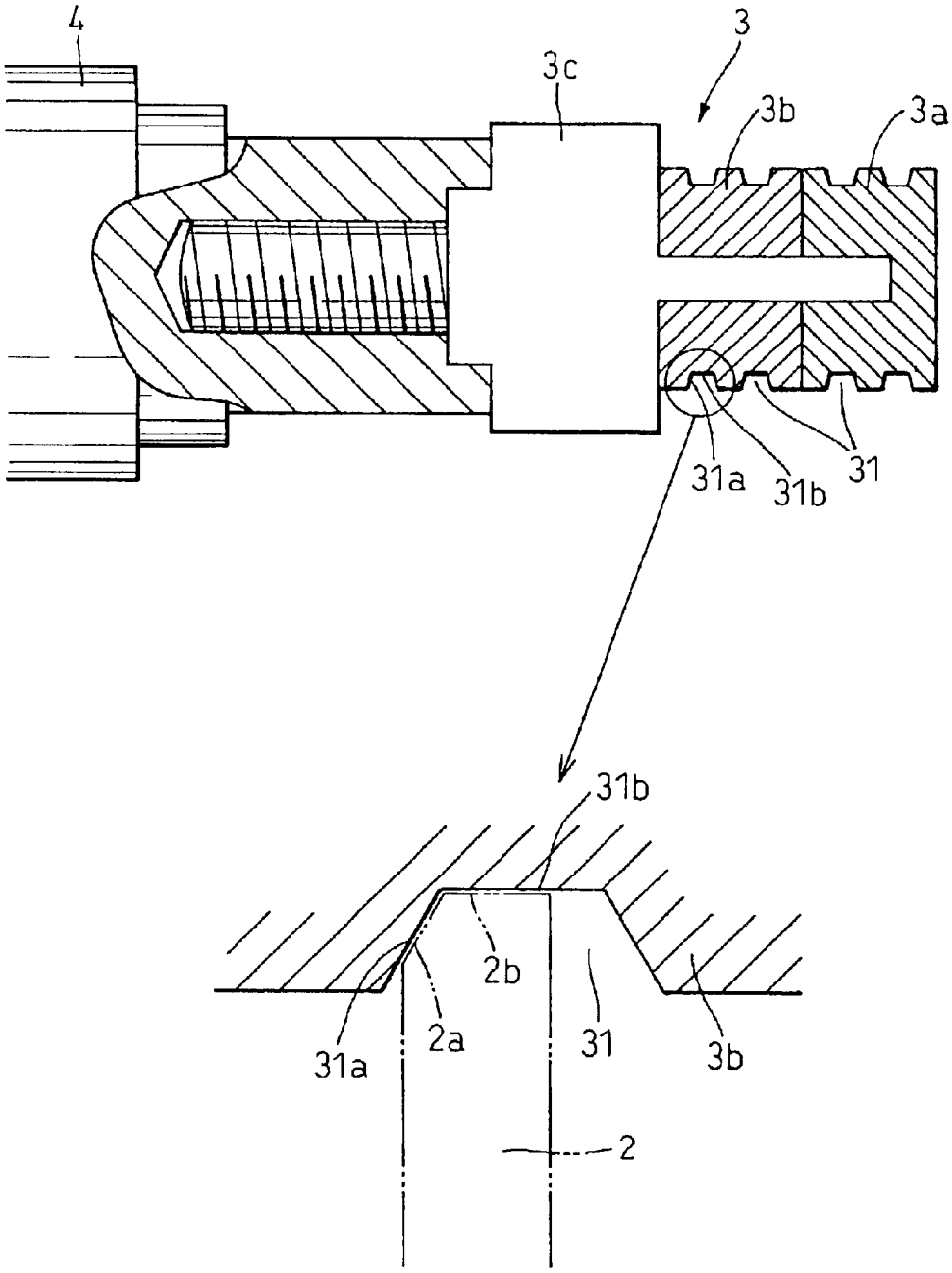
FIG. 3 is an enlarged sectional view of a grinding stone section fixed to a spindle.

FIG. 3 is a partially enlarged view showing the grinding stone section 3 which is attached to the spindle 4 by a male screw portion provided on grinding section 3 which is screwed and fixed into a female screw portion provided on spindle 4. The grinding stone section 3 includes: a bastard grinding stone portion 3*a*; a smooth grinding stone portion 3*b*; and an attaching portion 3*c*. A ring-shaped groove 31 is formed around the grinding stone. As shown in the enlarged view, the inclined portion 31*a* and bottom portion 31*b* of the groove 31 are used as a polishing face of the grinding stone. This inclined portion 31*a* polishes the chamfered face 2*a* in the peripheral edge of the semiconductor wafer 2, and the bottom portion 31*b* of the groove 31 polishes the outer circumferential face 2*b* of the wafer 2. In this polishing process, an oblique face, the angle of which is the same as that of the oblique face of the grinding stone groove, is self-formed according to the tilting angle of the grinding stone. Therefore, not only a portion of the oblique face but also the entire oblique face can be effectively utilized for polishing, and the number of acting abrasive grains of the grinding stone is increased. Accordingly, the acting abrasive grains can act uniformly on the polished face, and the face can be polished with high accuracy. In this connection, in this embodiment, the grinding stone section 3 includes two types of portions: a bastard grinding stone portion and a smooth grinding stone portion, which respectively provide different grain sizes. However, the grinding stone section 3 may be composed of only one type of grinding stone portion.

This embodiment adopts a grinding stone in which vitrified bond (V) or resinoid bond (B) is used, the degree of bonding of which is lower than that of metal bond (M) such as cast iron bond, Ni bond or Cu bond. The reason is that the abrasive grains easily come off when the grinding stone is given an overload, so that the polished surface can be prevented from being damaged. Next, referring to FIGS. 4A to 4E, explanations will be made into polishing notch portion 21 of the semiconductor wafer 2 by the polishing machine having the grinding stone shaft tilting mechanism for polishing a periphery of a sheet in accordance with the present invention. The semiconductor wafer 2 is held by a well known chuck not shown in the drawing and rotated, for example, at the rotating speed of 1 to 2 rpm. On the other hand, the grinding stone section 3 attached to the spindle 4 is rotated at a high rotating speed, for example, at the rotating speed of 2500 rpm in the same rotating direction as that of the semiconductor wafer 2 or in the direction reverse to that of the semiconductor wafer 2.

Figure 4A:
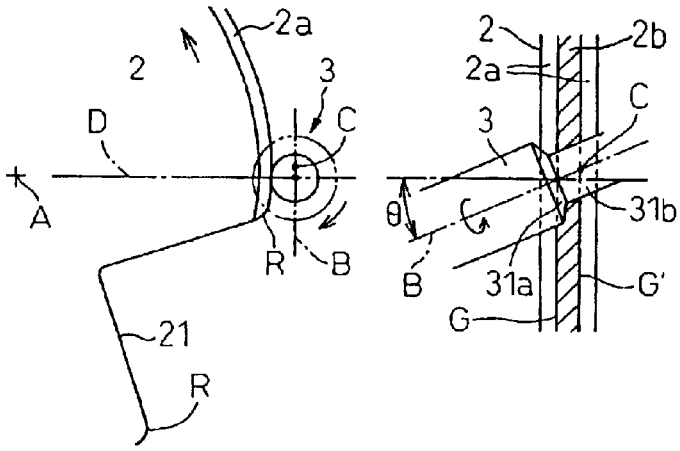
FIGS. 4A to 4E are schematic illustrations for explaining a polishing process of polishing a notch portion conducted by a polishing machine for polishing a periphery of a sheet of the present invention.

FIG. 4A is a view showing a polishing state in which the grinding section 3 is going to approach the notch portion 21 of the semiconductor wafer 2. The shaft of the spindle 4, which is a rotary shaft of the grinding stone section 3, is tilted with respect to the rotary shaft of the semiconductor wafer 2 by the angle θ. That is, the grinding stone section 3 is tilted by the angle θ in the tangential direction of the semiconductor wafer 2. This tilting angle θ is set at a predetermined angle according to the chamfering angle or the size of the wafer. In this case, the grinding stone section 3 is tilted in such a manner that the grinding stone section 3 is perpendicular to the center line D which connects the rotational center A of the semiconductor wafer 2 with the rotational center B of the grinding stone section 3 on a plane parallel with the plane of the semiconductor wafer 2. Point C is obtained when a point, at which a portion polished by the groove bottom section 31*b* of the grinding stone section 3 comes into contact with an outer circumferential line of the semiconductor wafer 2 on the opposite side, is projected on the rotary shaft center B of the grinding stone 3.

Figure 4B:
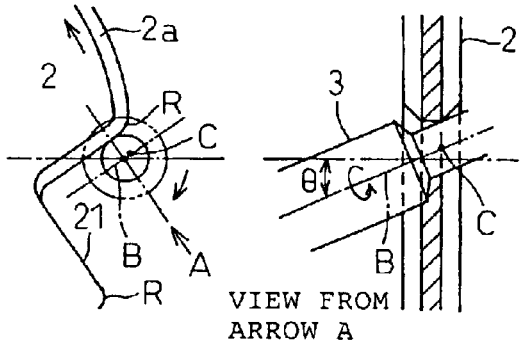

In the above polishing state, when the grinding stone section 3 approaches the curvature section R of the wafer in which the outer circumferential section of the semiconductor wafer 2 shifts to the notch portion 21, while the above tilting angle θ is being maintained, the grinding stone section 3 conducts polishing (chamfering) on the curvature section R while the tilting direction of the grinding stone section 3 is being changed. Then, polishing is conducted on the outward side of the notch portion 21 as shown in FIG. 4B. In this case, the grinding stone section 3 is moved in the directions of X and Y by a moving mechanism not shown so that the grinding stone section 3 can be moved along the linear oblique section of the notch portion 21, the plane of X and Y being parallel to a plane on which the semiconductor wafer is placed. Alternatively, the semiconductor wafer 2 is rotated and moved in the direction Y.

As shown in FIG. 4B, in this polishing process on the outward side of the notch portion 21 of the semiconductor wafer 2, according to the polishing angle of the notch portion 21, while the above tilting angle θ is being maintained, the tilting of the grinding stone section 3 is changed so that the tilting direction can be tilted to a direction parallel to the polishing face (chamfering face) from a direction perpendicular to the center line D.

Figure 4C:
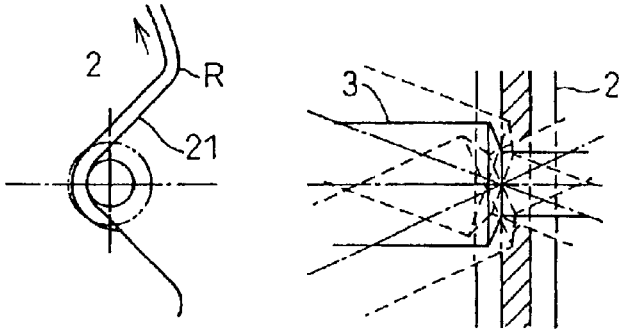

As shown in FIG. 4C, in the polishing process of polishing the bottom portion of the notch portion 21 of the semiconductor wafer 2, according to the change in the chamfering direction, the tilting direction of the grinding stone section 3 is changed in a reverse direction while the above tilting angle θ is being maintained.

Figure 4D:
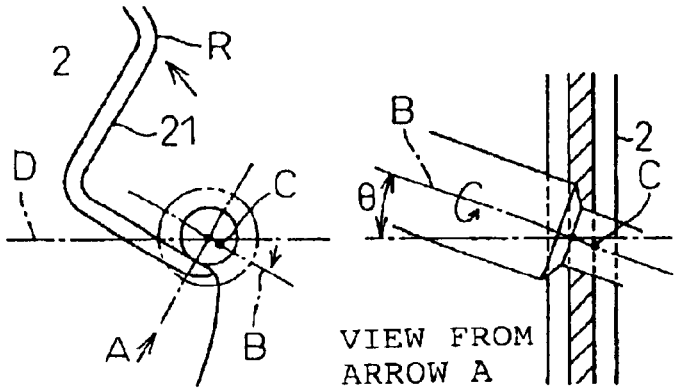

FIG. 4D is a view showing a polishing state on the inward side of the notch section 21. This polishing state is the same as that shown in FIG. 4B. Concerning the tilting of the grinding stone section 3, the above tilting angle θ is maintained, and the tilting direction is tilted to parallel to the polishing face of the wafer.

Figure 4E:
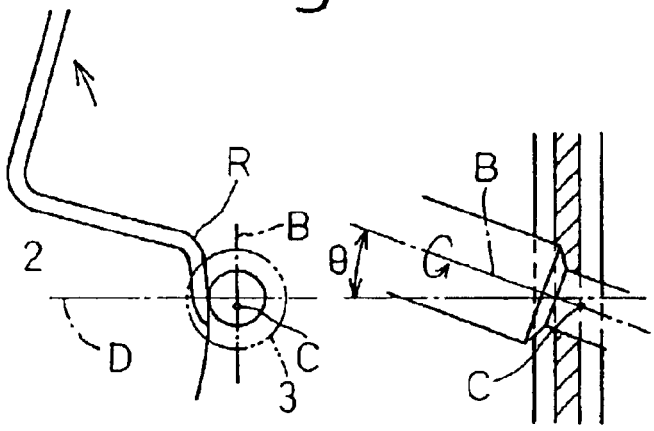

FIG. 4E is a view showing a state in which the notch portion 21 has been polished and the grinding stone section 3 arrives at the outer circumferential section of the semiconductor wafer 2 again. In the same manner as that of the polishing of the curvature section R on the outward side, while the grinding stone section 3 is maintaining the above tilting angle θ, the tilting direction is being changed, and the grinding stone section 3 polishes the curvature section R in which the notch portion 21 shifts to the outer circumferential section. Then, the grinding stone section 3 conducts polishing of the outer circumferential section.

In this case, the tilting direction is perpendicular to the center line D described before. The notch portion 21 of the semiconductor wafer 2 is polished as described above. In order to chamfer the reverse side of the semiconductor wafer 2, the height of the position of the semiconductor wafer 2 or grinding stone section 3 may be adjusted so that an oblique face opposed to the groove 31 of the grinding stone section 3 can be used.

In the case of the semiconductor wafer 2 having an orientation-flat marking portion which is formed by cutting linearly a part of the periphery of the circular wafer (not shown in the drawing), polishing can be performed in the manner described above. As another embodiment, polishing can be performed in the following manner. When polishing work arrives at the orientation-flat marking portion, while the tilting angle θ and the tilting direction of the grinding stone section 3 are being maintained, the orientation-flat marking portion may be polished so that the semiconductor wafer 2 or grinding stone section 3 can be linearly moved. In this case, rotation of the semiconductor wafer 2 is stopped and the grinding stone section 3 is kept rotating.

As another embodiment of polishing the orientation-flat marking portion, while the tilting angle θ of the grinding stone section 3 is being maintained, the orientation-flat marking portion may be polished so that the tilting direction can be changed in a reverse direction at the center of the orientation-flat marking portion.

Figure 5A:
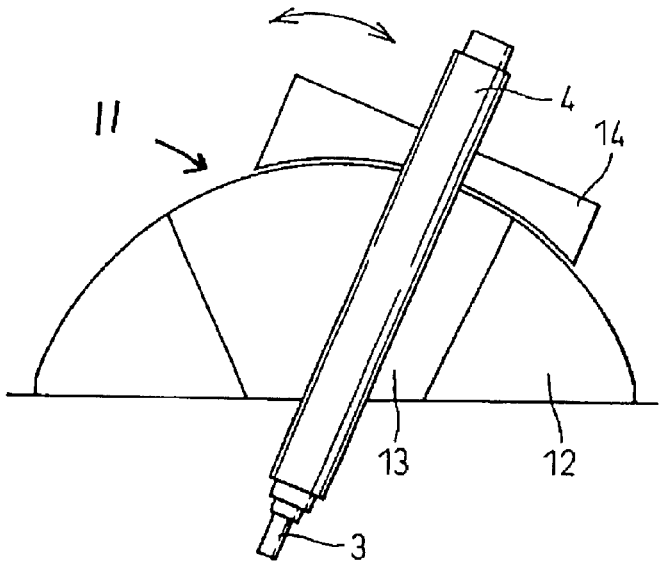
Figure 5B:
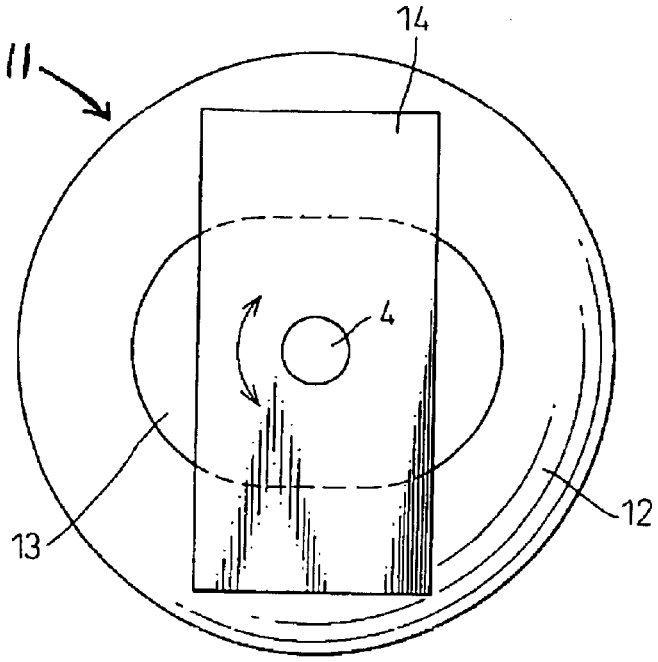

In this connection, in the grinding stone tilting mechanism used for the embodiment of the polishing machine for polishing a periphery of a sheet of the present invention, a means (linear bearing) for changing the tilting angle of the spindle 4, which is a grinding stone shaft, and a means (curvature type bearing) for changing the tilting direction are composed of different bearings. However, as shown in FIGS. 5A and 5B, both the tilting angle and the tilting direction can be changed by using one bearing. This can be realized when a spherical linear motor bearing 11, the profile of which is formed semispherical, is used. This spherical linear motor bearing 11 includes: a semispherical magnet 12 having an inverse-cone-shaped opening 13, both sides of which are cut off so that the spindle 4 holding the grinding stone section 3 can penetrate and tilt; and a magnetic body 14, the lower face of which is spherical, pivotally holding the spindle 4 and capable of rotating and sliding on spherical surface of the magnet 12. This spherical linear motor bearing 11 is driven by an electric drive means not shown in the drawing. Alternatively, it is possible to use such a spherical bearing, and drive it by a mechanical drive means.

As explained above according to the polishing machine for polishing a periphery of a sheet of the present invention, the grinding stone shaft tilting mechanism can change not only a tilting angle, by which the grinding stone shaft is tilted with respect to the rotary shaft of the semiconductor wafer, but also its tilting direction. Therefore, even a sheet having a recess portion and protrusion portion in the periphery edge can be accurately chamfered and polished.

In this connection, although the specific embodiment of the present invention is described above in detail, variations and modifications may be made by one skilled in the art without departing from the spirit and scope of the present invention.

What is claimed is:

1. A polishing machine for polishing a periphery of a semiconductor wafer in which the semiconductor wafer having a notch portion or an orientation flat marking portion in the periphery is rotated, a rotating grinding stone is made to come into contact with the periphery of the semiconductor wafer so as to polish the periphery and the notch portion or orientation flat marking portion, the polishing machine comprising:

a grinding stone shaft tilting mechanism capable of changing a tilting angle θ of a rotary shaft of the grinding stone to a tangential direction of the periphery of the semiconductor wafer and also capable of changing a tilting direction of the rotary shaft of the grinding stone so as to always maintain an angle with respect to the tangential direction according to a shape of the periphery of the semiconductor wafer, the grinding stone being a tilting fulcrum both for changing a tilting angle θ of the rotary shaft and for changing a tilting direction of the rotary shaft.

2. A polishing machine for polishing a periphery of a semiconductor wafer according to claim 1, wherein the tilting angle θ of the rotary shaft of the grinding stone to the tangential direction of the periphery of the semiconductor wafer is changed by the grinding stone shaft tilting mechanism according to a necessary chamfering angle of the semiconductor wafer.

3. A polishing machine for polishing a periphery of a semiconductor wafer according to claim 1, wherein the tilting direction of the rotary shaft of the grinding stone is changed so as to maintain the angle with respect to the tangential direction according to a rotary angle of the semiconductor wafer when polishing the notch portion or orientation flat marking portion in the periphery of the semiconductor wafer.

4. A polishing machine for polishing a periphery of a semiconductor wafer according to claim 2, wherein the tilting direction of the rotary shaft of the grinding stone is adjusted so as to maintain an angle with respect to the tangential direction of the periphery of the semiconductor wafer according to a rotary angle of the semiconductor wafer.

5. A polishing machine for polishing a periphery of a semiconductor wafer according to claim 1, wherein a degree of bonding of the grinding stone is lower than that of a metal bond.

6. A polishing machine for polishing a periphery of a semiconductor wafer according to claim 1, wherein the semiconductor wafer is a semiconductor wafer and the recess portion is a notch portion or orientation-flat marking portion.

* * * * *

UNITED STATES PATENT AND TRADEMARK OFFICE

CERTIFICATE OF CORRECTION

PATENT NO. : 6,913,526 B2
APPLICATION NO. : 10/110858
DATED : July 5, 2005
INVENTOR(S) : Honda It is certified that error appears in the above-identified patent and that said Letters Patent is hereby corrected as shown below:

On the Title Page

| | |
|---|---|
| Item (56) References Cited<br>U.S. Patent Documents<br>6,306,016. . . | Delete "Steere et al"<br>Insert --Steere, Jr. et al.-- |
| Column 8, line 12, Claim 3 | Delete "orientation flat",<br>Insert --orientation-flat-- |

Signed and Sealed this

Twenty-second Day of January, 2008

JON W. DUDAS
*Director of the United States Patent and Trademark Office*